United States Patent [19]

Kravath

[11] 4,422,193

[45] Dec. 27, 1983

[54] PARTITIONING DEVICE AND METHOD FOR POOLS

[76] Inventor: Ricahrd E. Kravath, 6 Scott St., Dobbs Ferry, N.Y. 10522

[21] Appl. No.: 365,177

[22] Filed: Apr. 5, 1982

[51] Int. Cl.[3] ..... E04H 3/19; E04H 3/18

[52] U.S. Cl. ..... 4/505; 4/502; 4/498

[58] Field of Search ..... 4/501, 505, 498, 499, 4/500, 502

[56] References Cited

U.S. PATENT DOCUMENTS

| | | | |
|---|---|---|---|
| 3,377,632 | 4/1968 | Peterson | 4/501 X |
| 3,780,385 | 12/1973 | Dunn | 4/501 |
| 3,816,859 | 6/1974 | Mosehauer | 4/501 |
| 3,871,033 | 3/1975 | Bartlett | 4/501 X |

*Primary Examiner*—Henry K. Artis

*Attorney, Agent, or Firm*—Anthony J. Casella; Gerald E. Hespos

[57] ABSTRACT

A partitioning device is provided for swimming pools to efficiently treat the water in swimming pools and to conveniently store the water therein during periods of nonuse. The device comprises a water tight bag constructed from a flexible fabric material such as plastic and appropriately sized and shaped to occupy at least the entire volume of the swimming pool. The partitioning device has at least one open end that can be attached to a conduit extending from a pumping and filtering device .Treated water is pumped into the partitioning device thereby providing an efficient separation between treated and untreated water. The treated water may be stored in the partitioning device for any convenient period of time. The device may easily be removed from the pool thereby leaving the pool filled with treated water.

6 Claims, 4 Drawing Figures

PARTITIONING DEVICE AND METHOD FOR POOLS

BACKGROUND OF THE INVENTION

Swimming pools, although desirable for recreational uses, create substantial operating burdens on their owners, and in many ways, are inconsistent with water conservation and environmental objectives. For example, virtually all swimming pools utilize a filtration and chemical treatment system to insure that the water in the pool remains acceptably pure. Filtration systems and pumping mechanisms vary widely. However, all of these varied systems operate on generally the same basic principle. Specifically, pool filtration systems utilize pumps which remove water from the pool, then filter and/or chemically treat the water, and finally recycle the treated water back into the pool. This approach of taking water from the pool, treating it and then mixing it back with the body of untreated water in the pool is extremely inefficient. As a result, the pumping, filtration and treating devices must be operated on almost a continuous basis. Clearly, this continuous operation of the water treatment system adds significantly to the maintenance costs of a swimming pool and imposes a substantial burden on the swimming pool owner.

Chemical treatments have been a central part of all swimming pool maintenance programs. Specifically, large amounts of algicide are required periodically. Additionally, superchlorination also is necessary to retard algae growth. This chemical treatment regimen requires a balancing that frequently goes beyond the ability of the typical pool owner. For example, if too few chemicals are placed in the pool, the resultant algae growth will render the pool unusable. However, if too large a dose of chemicals is placed in the pool, the chemicals themselves can render the pool unusable.

The most demanding and annoying swimming pool maintenance problems occur during periods of non-use. These periods may be short, such as mid-week period for a pool used only on weekends, or periods when the pool owner is away from the pool, such as for business or vacation traveling. However, the most demanding period occurs during the winter months when algae grows substantially, foreign debris accumulates in the pool, and water and chemicals evaporate.

Evaporation often is the most serious of the problems during extended periods of non-use. For example, many in-ground pools have walls that are subject to buckling or caving inward when the stabilizing force of the water in the pool is removed. In many other instances, a swimming pool is located in an area with a high water table, and the weight of the water in the pool is required to keep the pool from "floating" upward. Thus, in many instances, the water in pools must be periodically replenished even during off-seasons. This is a particularly annoying responsibility in locations where it is desirable to drain the water supply system in the vicinity of the pool during the off-season to protect against freezing.

To minimize off-season maintenance requirements, many pool owners empty their pool at the end of one swimming season, and refill it at the beginning of the next. This approach, of course, wastes a substantial volume of water thereby placing a strain on many already overtaxed reservoir systems. Additionally, the draining of the pool subjects near-by lakes, streams, and sewer systems to undesirably high levels of chemicals. Many pool owners choose not to drain their pools during the off-season or for the structural reasons explained above are not able to drain their pool. These owners have no option but to carry out the minimum maintenance requirements during these extended periods of non-use.

Pool covers are widely used to minimize maintenance requirements during periods of non-use. Typically, pool covers are stretched over the surface of the pool and are anchored to appropriately placed hardware about the perimeter of the pool. The installation and anchoring of the cover places significant stresses on the fabric of the cover. As a result, to ensure that the cover is not torn during installation or use, the covers are constructed from a heavy material. Although the heavy material insures durability of the cover, it adds substantially to the weight of the cover thereby making maneuvering and installation of the cover awkward and time consuming.

Although pool covers reduce off-season maintenance requirements, they have several other significant drawbacks. First, the covers generally do not completely eliminate the off-season evaporation of water and chemicals. Thus, even with a pool cover, it often is necessary to replenish the supply of water in the pool. Second, if the cover is not stored and secured to the anchoring mechanisms properly, they can be blown away thereby damaging the cover and other equipment or structures nearby. Third, pool covers are aesthetically unattractive. This is especially bothersome to many pool owners since the pools themselves are generally placed in a location where they will be extremely visible. As a result, during approximately half of each year, many pool owners have their attractive pools hidden by an extremely unsightly pool cover. Fourth, in many colder climates, swimming pools could readily function as ice skating rinks during winter months. However, swimming pool covers often are frozen into position, and therefore preclude use of the pool as an ice skating rink. Fifth, rain water generally accumulates on the pool cover during periods of non-use, requiring the pool owner to periodically drain the water from the cover. Sixth, the pool cover, once in position, occupies an area substantially larger than the pool. Finally, because of their area, thickness and weight, the pool covers generally require a large and frequently unattractive storage facility in close proximity to the swimming pool.

In systems where water is not completely emptied out of the pool during periods of extended non-use a major filtering and purification effort is required at the beginning of each swimming season. This effort requires considerable time and expense. Generally, it also requires substantial amounts of algicide to be mixed in with the water as well as an ambitious super-chlorination effort. These steps frequently render the pool unfit for swimming for many days.

In recent years, energy market characteristics have encouraged people to utilize devices with their swimming pool for solar heating or cooling purposes. A solar heating blanket or similar device generally is utilized to adapt the swimming pool for these purposes. These solar devices generally are quite expensive, and like pool covers, they are difficult to install, they are susceptible to damage, and they require a substantial storage area. Furthermore, unlike standard pool covers, many solar blankets must be kept out of the sun when not in use.

Accordingly, it is an object of the subject invention to provide an apparatus that will enable more efficient cleaning of water in a swimming pool.

Another object of the subject invention is to provide an apparatus for the cleaning of water in a swimming pool without mixing cleaned water with dirty water.

It is a further object of the subject invention to provide an apparatus that will reduce the amount of chemicals used in swimming pools.

It is another object of the subject invention to provide an apparatus that will eliminate the need to utilize a swimming pool cover during periods of non-use.

It is still a further object of the subject invention to provide an apparatus that will ensure a full supply of clean water during extended periods of non-use.

It is an additional objective of the subject invention to eliminate the need to empty swimming pools during extended periods of non-use.

It is still an additional object of the subject invention to provide an apparatus that will reduce the water requirements of swimming pools.

It is still a further object of the subject invention to provide an apparatus that can be used both for water purification purposes and for solar heating or cooling purposes.

It is a further object of the subject invention to provide an apparatus that will preserve and protect the water in the swimming pool during off-seasons and that also will enable the swimming pool to be utilized for ice skating.

It is yet another object of the subject invention to provide an apparatus that will inhibit algae growth during periods of non-use.

It is another object of the subject invention to provide an apparatus for swimming pool filtration purposes that is lightweight, aesthetically attractive, easy to maneuver, easy to use, inexpensive, and readily manufactured.

SUMMARY OF THE INVENTION

The subject invention is directed to a partitioning device for separating clean water from dirty water within a swimming pool or other similar body of water such as a garden pool, pond, or aquarium. The partitioning device preferably is a large water-tight bag constructed from a flexible fabric material such as plastic. The precise size and shape of the bag is not critical; however, it is essential that the bag be large enough to hold the desired amount of water in the pool and to assume the shape of the pool when filled. Because the bag is large enough to assume the shape of the pool, the forces exerted by the water in the bag always will be balanced by the existing walls of the pool either acting directly on the bag or on water outside the bag. As a result, the forces exerted on the walls of the bag will be small, and the bag can be constructed from a relatively thin material with only moderate strength. Due to the relative thinness of the material from which the bag is made, the bag will be relatively light as compared to pool covers typically used to keep material from falling into pools.

The subject bag includes an opening for the ingress and egress of water. Preferably, the opening is adaptable to accept a coupling device which in turn can be connected to the existing filtration system for the swimming pool. In operation, a conduit used with the pumping mechanism of the swimming pool is attached to the bag so that clean water may be pumped into the bag. The empty bag with the conduit attached is merely placed on the surface of the pool and a pumping operation is begun. As clean water is pumped into the bag, dirty water is pumped out of the pool. In most operations, the dirty water pumped out of the pool will be processed through appropriate filtration devices attached to the pump, and then will be pumped into the bag. In certain other applications, it may be desirable to totally replace the water in the swimming pool without completely emptying it. In those cases, the dirty water in the pool is merely pumped into an appropriate drain, and fresh water is pumped into the bag. This latter arrangement ensures a completely fresh supply of water, and also ensures that the pool will remain filled with water, thereby eliminating potential floating of the pool or collapse of the pool walls.

After removal of the entire amount of dirty water from the swimming pool and after appropriate filling of the bag with clean water, the pumping operation ceases. The clean water may then be stored in the bag for any period of time or may simply be released into the swimming pool immediately. Preferably, the opening in the bag is of the type that can be held securely around the conduit during a filling operation, but that also can be opened widely to selectively enable rapid discharge of the water secured in the bag.

The subject bag can be constructed from two dissimilar sheet material members wherein one is heat and light reflective and the other is heat absorptive material. This will enable the subject bag to be used for appropriate solar heating or cooling purposes, and to help inhibit algae growth in the bag. For example, for solar heating purposes, the heat absorptive side would face up so that sunlight would warm the water in the bag. Conversely, to inhibit algae growth in the bag, or to adapt the bag for cooling purposes, the heat and light reflective surface would face up.

The subject apparatus also enables the swimming pool to be easily adaptable for ice skating during winter months. For example, the bag could be filled less than completely so that a few inches of water could be deposited on the upper surface of the bag. Once frozen, this upper layer of water would provide a smooth continuous surface for ice skating.

The apparatus described herein enables the pool's filtration system to produce clean water that can be recirculated into the enclosure provided by the pool without having that clean water mixed with the dirty water already in the pool. This can reduce the frequency for cleaning operations, and can further reduce the need for having to completely replace the water in the pool. As a result, fewer chemicals and less water need be used, and the filtering devices need not be run as often as in prior art arrangements. Additionally, the arrangement enables the storage of clean water for long periods of time, such as the colder seasons during which the pool is not in use. The subject apparatus is lightweight, maneuverable, and easily adaptable to any existing filtration system. Finally, the subject apparatus provides a single member which can be used for purifying the pool water, maintaining clean water and protecting the pool during off-seasons, providing the necessary heat absorptive or reflective conditions necessary for a solar heating or cooling system and enabling adaption of the system for ice skating.

The principles described above also can be applied by utilizing a single flat sheet of fabric material such as plastic. This sheet of material would be placed over the pool so that it extends substantially beyond the perimeter of the pool on all sides. Clean water then could be pumped onto the top side of the sheet of material while the untreated water is being removed from the bottom. The weight of the clean water would force the partitioning sheet downward as the dirty water is removed from the pool, thereby keeping the dirty and clean water separated, and still enabling the entire volume of the pool to remain filled. This arrangement does not enable cleaned water to automatically be protected from debris that might fall into the pool. Similarly, it does not inhibit the growth of algae. However, it could be produced less expensively, and in certain operations opposed edges of the sheet material partition could be folded on top of one another to effect the necessary closing.

DETAILED DESCRIPTION OF THE PREFERRED EMBODIMENT

Figure 1:
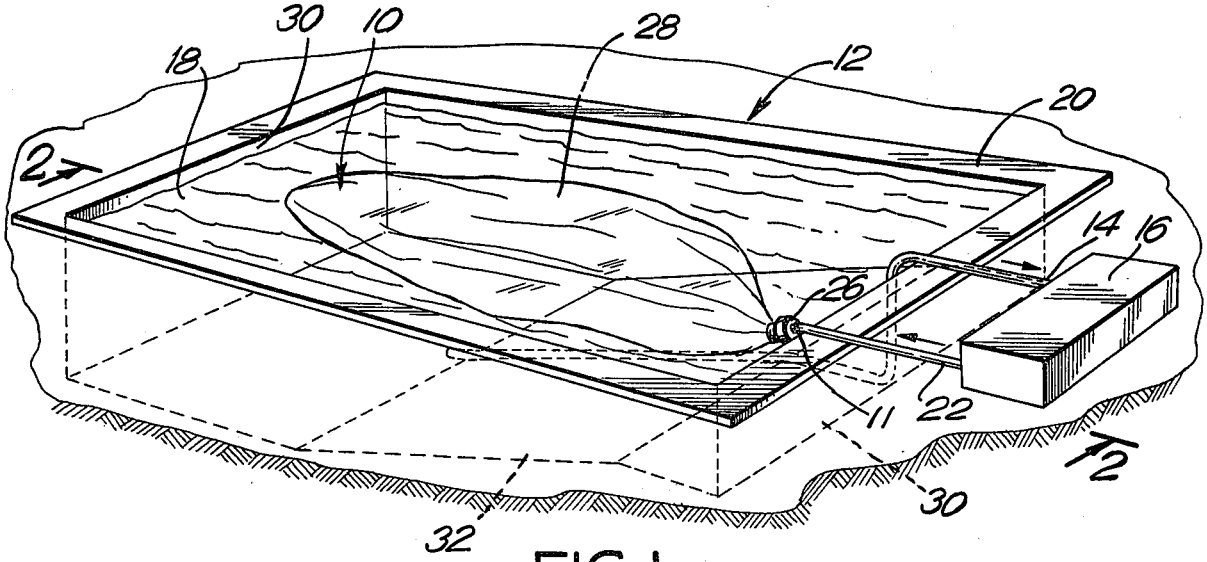
FIG. 1 is a perspective view of a filled swimming pool having the subject partitioning device empty and floating on the surface thereof.

The partitioning device 10 of the subject invention, as shown in FIG. 1, is a bag shaped structure fabricated from a water impervious flexible sheet material such as plastic. Preferably, the bag shaped structure of partitioning device 10 has a single opening 11, with the remainder of partitioning device 10 defining an integral enclosure. Other arrangements can be constructed, however, wherein partitioning device 10 has more than one opening, provided the additional openings are all sealable.

As shown in FIG. 1, partitioning device 10 is used in conjunction with swimming pool 12. Although FIG. 1 depicts a rectangular inground swimming pool, the subject partitioning device 10 can be adapted to pools of any shape, either above or inground. Similarly, partitioning device 10 may be employed with pools other than those used for swimming, such as garden pools. In the FIG. 1 arrangement, partitioning device 10 is empty, and the flexible sheet material from which it is made is rolled or folded onto itself. As a result, the partially rolled and folded partitioning device 10 is considerably smaller than it would be if the flexible sheet material from which it is constructed was extended to its maximum dimension.

Partitioning device 10 can assume any of a variety of sizes and configurations. However, it is essential that partitioning device 10 be of a size and configuration to enable it to at least completely occupy swimming pool 12. Swimming pool 12 is provided with egress conduit 14 which extends from swimming pool 12 to pumping and filtration device 16. Untreated water 18 in swimming pool 12 is pumped through egress conduit 14 by pumping and filtration device 16. The pumping and filtration device 16 then treats untreated water 18 appropriately to remove foreign matter, kill bacteria or add chemicals as needed, warm or cool the water and perform other related functions. Egress conduit 14 and pumping and filtration device 16 are both depicted in FIG. 1 as being above ground, with egress conduit 14 extending over the lip 20 of pool 12 and into the untreated water 18. Although this arrangement, as depicted in FIG. 1, is quite operable, in many systems the pumping and filtration devices will be subgrade, and the egress conduit will be incorporated into the wall or bottom of the pool.

Ingress conduit 22 extends from pumping and filtration device 16 to partitioning device 10. More specifically, opening 11 of partitioning device 10 is attached to ingress conduit 22. Coupling device 26 is slipped over open end 11 of partitioning device 10 to ensure an airtight and watertight connection between ingress conduit 22 and partitioning device 10. As shown in FIG. 1, coupling device 26 is a collar mechanism which is slipped over open end 11 of partition device 10 and is secured in position by threadable engagement with ingress conduit 22. Other coupling devices are equally acceptable. For example, open end 11 of partition device 10 could merely be placed over one end of ingress conduit 22, gathered together tightly and tied in that arrangement by an appropriately dimensioned nylon rope or strap. To facilitate the gathering of partitioning device 10 over ingress conduit 22, a draw string may be incorporated into partitioning device 10 near open end 11. Because of the minimal forces imposed on partitioning device 10, the coupling device need be only moderately strong.

Treated water 28 which has been processed by pumping and filtration device 16 is urged through ingress conduit 22 into partitioning device 10. The rate of flow of treated water 28 through ingress conduit 22 substantially equals the rate of flow of untreated water 18 through egress conduit 14.

Figure 2:
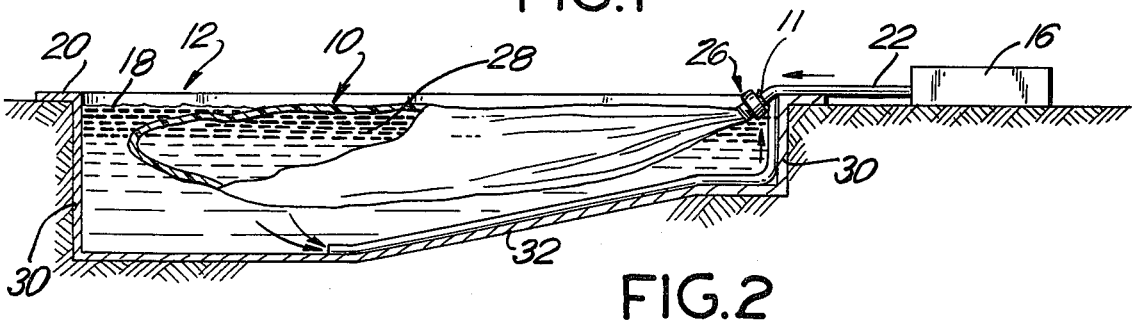
FIG. 2 is a cross-sectional side view of a swimming pool having the subject partition disposed in the pool, and partially filled with clean water.

In FIG. 2, partitioning device 10 is partially filled. However, because the rate of flow of untreated water 18 through egress conduit 14 substantially equals the rate of flow of treated water 28 through ingress conduit 22, the total volume of water in pool 12 remains substantially constant. This ability of partitioning device 10 to keep pool 12 continuously filled is of significant in several respects. First, it assures that the force exerted on the side walls 30 and bottom surface 32 of pool 12 will not vary. This enables the untreated water 18 in pool 12 to be completely recycled without risking collapse of side walls 30 or the upward floating of the entire pool structure defined by side walls 30 and bottom surface 32. Second, partitioning device 10 will at all times be surrounded on its bottom and side surfaces by either untreated water 18 or by the side walls 30 and bottom surface 32 of the pool 12. As a result, partitioning device 10 will not have to compensate for all forces exerted by treated water 28. Rather, at any particular instant, the forces exerted by treated water 28 will be balanced by equal and opposite forces exerted by untreated water 18 and/or side walls 30 and bottom surface 32 of pool 12. Consequently, partitioning device 10 only has to withstand the small forces caused by the movement of water, and can be fabricated from a thin, lightweight and inexpensive material.

Figure 3:
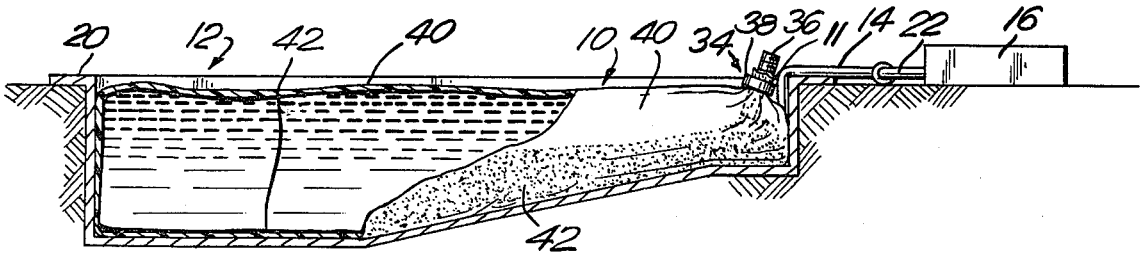
FIG. 3 is a cross-sectional side view of a swimming pool and a partitioning device wherein the partitioning device is completely filled with water and encompasses substantially the entire volume of the swimming pool.

In FIG. 3, all of the untreated water 18 that had been in pool 12 has been treated and pumped into partitioning device 10. As a result, partitioning device 10 occupies substantially the entire volume of pool 12. Walls 30 and bottom surface 32 of pool 12 support partitioning device 10 so that the forces exerted by the treated water 28 in partitioning device 10 do not impose any significant stress on the walls of partitioning device 10. As explained above, this enables partitioning device 10 to be constructed from a thin, lightweight and inexpensive material.

After partitioning device 10 has been sufficiently filled with treated water 28, ingress conduit 22 may be removed from partitioning device opening 11. Partitioning device opening 11 then may be securely sealed as in FIG. 3, or allowed to open widely as in FIG. 4. The secure sealing of partitioning device opening 11 enables treated water 28 to remain in partitioning device 10 for any desired length of time. As explained briefly above, this period of non-use may extend for a few days or several months. During the period of non-use, the treated water 28 stays clean as a result of being completely enclosed in partitioning device 10. Furthermore, the treated water 28 in partitioning device 10 exerts a force on walls 30 and bottom surface 32 of pool 12 equal to the force exerted by the water without partitioning device 10. As a result, the pool will neither collapse nor "float".

Partitioning device opening 11 may be securely closed in any of a number of ways. For example, as shown in FIG. 3, a closing device 34 similar to coupling device 26 could be provided. In this arrangement, partition device opening 11 is gathered around threaded bolt member 36 of closing device 34. Collar 38 then is threadably engaged onto bolts 36 thereby securely closing partition device opening 11. In the alternative, partition device opening 11 merely could be gathered together and tied shut with a rope, strap, or similar means. As explained above, a draw string could be incorporated into partitioning device 10 near opening 11 to facilitate the gathering of partitioning device 10.

Figure 4:
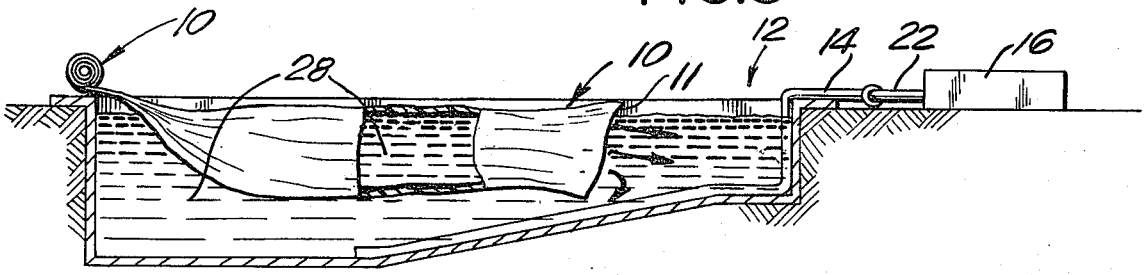
FIG. 4 is a cross-sectional side view of a swimming pool and partitioning device as the water is being removed.

When it is desired to return the treated water 28 to pool 12, the closing device 34 is removed allowing partitioning device opening 11 to open as in FIG. 4. In many instances, partitioning device opening 11 may have to be manually urged into its fully opened position. However, this manual opening is a simple task requiring only a minimum amount of force by the owner or operator of the pool 12. A small amount of fresh water can be directed into pool 12 outside partitioning device 10 to facilitate the initial movement of partitioning device 10. Treated water 28 from partitioning device 10 then is allowed to flow into the pool as partitioning device 10 is removed. It is important to emphasize that although in some instances the treated water 28 will remain in partitioning device 10 for a long period of time, in many other cases, treated water 28 may be removed from partitioning device 10 immediately after all of the untreated water 18 is removed from pool 12. In this manner, partitioning device 10 is used mostly to enable a more efficient treatment of untreated water 18 in swimming pool 12 during a swimming season.

Partitioning device 10 is removed from pool 12 as the treated water 28 flows from partitioning device 10, through partitioning device opening 11 and into pool 12, as in FIG. 4. In most instances, partitioning device 10 is rolled or folded at the edge of pool 12 as it is removed. Because of the light weight of partitioning device 10, and because of the minimum forces exerted on partitioning device 10, the removal of partitioning device 10 from pool 12 can be accomplished easily by hand. However, a simple mechanical apparatus such as a pair of rollers and a winch could be utilized to facilitate the removal of partitioning device 10.

As shown most clearly in FIG. 3, partitioning device 10 when filled entirely with treated water 28 is a few inches below lip 20 of pool 12. During winter months, a layer of water may be deposited on top of partitioning device 10 and allowed to freeze, thereby providing a thin layer of ice over the entire surface of partitioning device 10 and within the entire area defined by lip 20 of pool 12. By this arrangement, pool 12 may be used as an ice skating rink during the colder winter months.

In certain embodiments, partitioning device 10 may be constructed from two dissimilar materials wherein one material is light and heat reflective and the other is heat absorptive. As shown in FIG. 3, for example, portion 40 of partitioning device 10 is a heat absorptive material, and portion 42 is a light and heat reflective material. For solar heating purposes, it would be desirable to have portion 40 of partitioning device 10 face up, and to have portion 42 of partitioning device 10 face down. By this arrangement, the treated water 28 within partitioning device 10 would absorb and retain heat. Appropriate connections could then be made to treated water 28 within partitioning device 10 to enable the solar heat treated water 28 to be used for solar heating purposes. In a similar manner, the body of treated water 28 within partitioning device 10 could be made less conducive to algae growth or could be used for cooling purposes by merely reversing the heat absorptive portion 40 with the heat and light reflective portion 42 of partitioning device 10. Specifically, portion 40 of partitioning device 10 could face down and portion 42 could face up.

In summary, a partitioning device is provided for swimming pools to provide a more efficient arrangement for treating water in swimming pools, and to provide a convenient arrangement for storing clean water in a swimming pool during periods of non-use. The partitioning device includes a large water-tight bag constructed from a flexible fabric material such as plastic. The bag is of a sufficient size and shape to enable it to occupy at least the entire volume of the swimming pool with which it is used. The bag includes an open end which can be attached to an ingress conduit extending from a pumping and filtering device. An egress conduit is also provided extending from the body of untreated water in the swimming pool to the pumping and filtering device. In operation, the bag is fixedly attached to the ingress conduit and is placed in the pool. Subsequently, the pumping and filtration device is operated to remove untreated water from the swimming pool, treat the water, and pump the treated water into the bag or partitioning device. As the bag is being filled with treated water, forces exerted by the untreated water in the swimming pool support the partially filled bag or partitioning device with treated water. Consequently, there are few stresses imposed on the walls of the partitioning device thereby enabling the partitioning device to be constructed from a lightweight, thin and inexpensive material. Similarly, when all of the untreated water has been removed from the swimming pool and the partitioning device is filled with treated water, the walls and bottom surface of the swimming pool provide the necessary support for the enclosed body of treated water, thereby minimizing the forces that must be exerted by the walls of the partitioning device. By the arrangement described herein, the swimming pool remains entirely filled with water throughout a treatment operation thereby insuring that the walls of the swimming pool will not collapse and that the entire swimming pool structure will not "float" upwardly. The treated water enclosed in the partitioning device is easily returned to the swimming pool by merely opening the partitioning device and removing the partitioning device from the swimming pool. During the winter months, a layer of water may be placed on top of the filled partitioning device, and allowed to freeze thereby enabling use of the swimming pool as an ice skating rink. Additionally, the partitioning device may be fabricated with heat reflective and heat and light absorptive portions thereby enabling the partitioning device to be adapted to solar heating and cooling purposes, or to inhibit algae growth.

While the preferred embodiment of the subject invention has been described and illustrated, it is obvious that various changes and modifications can be made therein without departing from the spirit of the present invention which should be limited only by the scope of the appended claims.

What is claimed is:

1. A swimming pool partitioning device for efficient treatment and storage of water in a swimming pool, said partitioning device for use with a swimming pool having a water pumping and treating system comprising a water treatment device for filtering and chemically treating the water, an egress conduit in communication with the water in the swimming pool and with the water treatment device for accommodating the flow of water from the pool to the water treatment device, an ingress conduit in communication with said water treatment device for accommodating the flow of treated water from said water treatment device, and a pump for urging the flow of water from the swimming pool, through the egress conduit, the water treatment device and the ingress conduit, said swimming pool partitioning device comprising:

a water tight, flexible container means having at least one opening and having a size and shape enabling said container means to substantially occupy the swimming pool, said container means being unattached to said pool to enable removal of said container means from the pool when the container means is empty; and a coupling means for releasably securing the opening of said container means to said ingress conduit of said pumping and treatment system, whereby water from said swimming pool treated by the water treatment device of said pumping and treating system is urged through said ingress conduit and into said partitioning device thereby separating the water in said swimming pool that has passed through the pumping and treating system from the water in said swimming pool that has not passed through the pumping and treating system.

2. A swimming pool partitioning device as in claim 1 wherein said flexible container means is constructed from a plastic sheet material.

3. A swimming pool partitioning device as in claim 2 wherein said means for releasably securing said partitioning device to the ingress conduit is a cylindrical internally threaded collar threadably connectable to the ingress conduit such that said collar can securely retain the partitioning device when the open end of the partitioning device is placed over and gathered around the ingress conduit.

4. A swimming pool partitioning device as in claim 1 wherein said flexible container means is constructed from first and second sheets of material, said first sheet being heat absorbtive and said second sheet being heat and light reflective such that when said first sheet is facing up in said swimming pool, said partitioning device is adaptable to a solar heating system, and when said second sheet is facing up in said swimming pool said partitioning device inhibits algae growth and is adaptable to a cooling system.

5. A partitioning device for treating and storing liquid in a pool, said partitioning device for use with a pool having a liquid treatment device, an egress conduit in communication with the liquid in the pool and with the liquid treatment device, an ingress conduit in communication with said liquid treatment device and with said partitioning device, and a pump for urging liquid from the pool, through the egress conduit, the liquid treatment device and the ingress conduit and into said partitioning device, said partitioning device comprising:

a liquid impervious, flexible container constructed from plastic sheet material having an opening and having a size and shape enabling said container to substantially occupy the pool said container being free from the pool to enable removal of the container from the pool when the container is empty; and a coupling member for releasably securing the opening of said container to said ingress conduit, whereby liquid from said pool treated by the liquid treatment device is urged through said ingress conduit and into said partitioning device thereby separating the liquid in said pool that has passed through the liquid treatment device from the liquid in said pool that has not passed through the liquid treatment device.

6. A swimming pool partitioning device as in claim 2 wherein the opening in the container means is capable of being widely opened to enable the rapid release of water therefrom.

* * * * *